United States Patent [19]

Ajiki et al.

[11] Patent Number: 4,469,061

[45] Date of Patent: Sep. 4, 1984

[54] VALVE ACTUATING METHOD FOR INTERNAL COMBUSTION ENGINE WITH VALVE OPERATION SUSPENDING FUNCTION

[75] Inventors: Yoshio Ajiki, Saitama; Shoichi Honda; Masaaki Matsuura, both of Tokyo, all of Japan

[73] Assignee: Honda Giken Kogyo Kabushiki Kaisha, Tokyo, Japan

[21] Appl. No.: 512,048

[22] Filed: Jul. 8, 1983

[30] Foreign Application Priority Data

| | | | |
|---|---|---|---|
| Jul. 8, 1982 | [JP] | Japan | 57-118991 |
| Jul. 8, 1982 | [JP] | Japan | 57-118992 |
| Jul. 19, 1982 | [JP] | Japan | 57-125381 |
| Jul. 28, 1982 | [JP] | Japan | 57-131612 |
| Aug. 2, 1982 | [JP] | Japan | 57-135035 |

[51] Int. Cl.[3] ..... F02D 13/06

[52] U.S. Cl. ..... 123/198 F; 123/90.16; 123/90.27; 123/90.43

[58] Field of Search ..... 123/198 F, 90.15, 90.16, 123/90.43, 90.44, 90.46

[56] References Cited

U.S. PATENT DOCUMENTS

| | | | |
|---|---|---|---|
| 4,064,861 | 12/1977 | Schulz | 123/198 F |
| 4,151,817 | 5/1979 | Mueller | 123/198 F |
| 4,167,931 | 9/1979 | Lizuka | 123/198 F |
| 4,188,933 | 2/1980 | Lizuka | 123/198 F |
| 4,203,397 | 5/1980 | Soezens, Jr. | 123/198 F |
| 4,284,042 | 8/1981 | Springer | 123/198 F |
| 4,336,775 | 6/1982 | Meyer | 123/198 F |
| 4,387,680 | 6/1983 | Tsunetomi et al. | 123/198 F |

*Primary Examiner*—Ira S. Lazarus

*Attorney, Agent, or Firm*—Sughrue, Mion, Zinn, Macpeak, and Seas

[57] ABSTRACT

Method and apparatus for suspending valve actuation for use in an internal combustion engine is disclosed. Each of intake and exhaust valves is normally actuated by a rocker arm operated by a cam in synchronism with an engine operation. The rocker arm is supported at one end by a supporting member held to a cylinder head by means of a retaining member. The supporting member is selectively floatable with respect to the cylinder head to thereby effect suspension of valve operation. The supporting member is then held at a position where sliding contact between the rocker arm and the cam is prevented.

7 Claims, 11 Drawing Figures

VALVE ACTUATING METHOD FOR INTERNAL COMBUSTION ENGINE WITH VALVE OPERATION SUSPENDING FUNCTION

BACKGROUND OF THE INVENTION

The present invention relates to a valve actuating method for opening and closing intake valves and exhaust valves in internal combustion engines while suspending the operation of the some of these valves to keep them in the closing positions in response to the state of operation of the engine.

Hitherto, such an internal combustion engine has been known as having at least three valves including intake and exhaust valves on each cylinder, wherein all of the three valves are actuated in high-speed operation of the engine to increase the output power from the engine, while, in the low or medium operation of the engine, a part of the intake or the exhaust valves are held in the closed state and made to suspend the operation to increase the output power in the low and medium speed regions.

This type of engine incorporates a valve actuating mechanism having a valve operation suspending function for suspending at least one of the intake and exhaust valves. FIG. 1 shows such a valve actuating mechanism having a valve operation suspending function, incorporating a hydraulic lifter as a retaining means. In FIG. 1, a reference numeral 1 denotes a cam, 2 denotes an intake valve or an exhaust valve, 3 denotes a rocker arm, and 4 denotes a hydraulic lifter i.e. the retaining means supporting the fulcrum of the rocker arm. The hydraulic lifter 4 includes a hollow plunger, i.e. a supporting member, which engages at its upper end with the fulcrum of the rocker arm 3, a casing 8 slidably accomodating the plunger 5 with a high-pressure chamber 6 defined at the lower side of the plunger 5 and provided at the lower end thereof with an oil discharge port 7 for discharging oil from the high-pressure chamber 6, a check valve 9 disposed in an opening between the hollow 5*a* in the plunger 5 and the high-pressure chamber 6 and adapted for preventing pressurized oil from flowing back into the hollow 5*a* from the high-pressure chamber 6, and oil supply passages 10*a* and 10*b* for supplying the hollow portion 5*a* of the plunger 5 with oil. The check valve 9 has a ball valve 11 biased by a spring 13 in a retainer 12 and seated on a valve seat formed around the opening. A spring 14 for upwardly biasing the plunger 5 is disposed in the high-pressure chamber 6.

A discharge limiting valve 15 is adapted to limit the discharge of the oil from the oil discharge port 7. The discharge limiting valve, accomodated by the casing 8, has a valve seat formed in a passage 16 leading to the outside of the casing 8, a ball valve 17 biased by a spring 19 in a retainer 18 so as to be seated on the valve seat, and a push rod 21 driven by a solenoid 20 to push the ball valve 17. A reference numeral 22 denotes an intake or exhaust manifold, 23 denotes a valve guide an 24,25 denote valve springs.

In the normal operation of this valve actuating mechanism, the rocker arm 3 makes a rocking motion around the fulcrum supported by the plunger 5 of the hydraulic lifter 4 to open and close the valve 2 in each rotation of the cam 1. The hydraulic lifter 4 can maintain the clearance in the valve actuating mechanism zero to afford a silent and maintenance-free operation. As the solenoid 20 is energized as necessitated, the push rod 21 is moved to the left as viewed in the drawings to push the ball valve 17 so that the passage 16 is opened to relieve the oil from the high-pressure chamber 6 so that the plunger 5 supporting the fulcrum of the rocker arm 3 is lowered when the cam 1 takes the lifting position, because the force of the spring 14 for upwardly biasing the plunger 5 is smaller than the force of the valve springs 24,25. Therefore, the rotation of the cam 1 causes only up and downward movement of the rocker arm 3 so that the valve 2 is held in the closed position to suspend its operation.

With the conventional valve actuating mechanism explained above, it is possible to increase the output power of the engine in the low and medium speed range of the engine operation by suspending the operation of a part of the valves. The plunger 5 in the hydraulic lifter 4, however, makes an up and downward reciprocal motion by the action of the rocker arm 3 and the spring 14 following up the operation of the cam 1 even during the suspension of operation of the valve. Thus, the engine is obliged to make a wasteful work for driving the plunger 5 uselessly overcoming to force of the spring 14. In addition, during the reciprocal motion of the plunger 5 mentioned above, the oil is made to flow into and out of the high-pressure chamber 6 through the passage 16 in the discharge limiting valve 15. This state tends to cause a generation of the bubbles in the oil due to a phenomenon called cavitation. If there is any bubble remaining in the high-pressure chamber 6, the hydraulic lifter 4 cannot perform its function to make the fulcrum 3 of the rocker arm 3 rigid. Furthermore, the bubbles produced by the cavitation contain an ozonic air which tends to promote the corosion of mechanical parts.

SUMMARY OF THE INVENTION

Accordingly, it is a first object of the invention is to provide a valve actuating mechanism having a valve operation suspending function in which the reciprocal motion of the plunger of the hydraulic lifter is suspended during the suspension of operation of the valve to eliminate any loss of power due to wasteful work and to ensure the functioning of the hydraulic lifter by avoiding generation of bubbles in the oil, thereby to overcome the above-described problems of the prior art.

It is a second object of the invention to provide a valve actuating mechanism having valve operation suspending function, wherein a suitable moment is applied to the rocker arm during suspension of operation of the valve to prevent any vibration or offsetting of the rocker arm which may be incurred by the vibration of the engine when the rocker arm is in the depressed state to cause chattering noise due to vibratory contact between the rocker arm and the cam.

It is a third object of the invention to provide a valve actuating mechanism with a valve operation suspending function, wherein the rocker arm is prevented from rocking during suspension of the valve, by arranging such that the direction of the sliding motion of the plunger of the hydraulic lifter supporting the fulcrum of the rocker arm substantially coincides with the direction of movement of the valve member of the discharge limiting valve for opening and closing the high-pressure chamber of the hydraulic lifter.

These and other objects of the invention will be attained by a valve actuating method with a function for suspending valve operation in an internal combustion engine, wherein an intake valve or an exhaust valve is actuated by a rocker arm operated in response to the operation of the valve actuating cam in synchronism with the engine operation. The rocker arm is supported at its one end in a rigid manner by a supporting member retained by the cylinder head of the engine through a retaining member. The retention of the supporting member by the retaining member is selectively dismissed to nullify the supporting reactional force for the rocker arm to permit the supporting member to float thereby to effect a suspension of operation of the valve. The improvement of this invention resides in that the retention of the supporting member by the retaining member is dismissed to permit the supporting member to float with respect to the cylinder head and that the supporting member is held at a position where the rocker arm and the valve actuating cam do not make sliding contact with each other.

DESCRIPTION OF THE PREFERRED EMBODIMENT

A preferred embodiment of the invention will be described hereinunder with reference to FIGS. 2 to 10.

Figure 1:
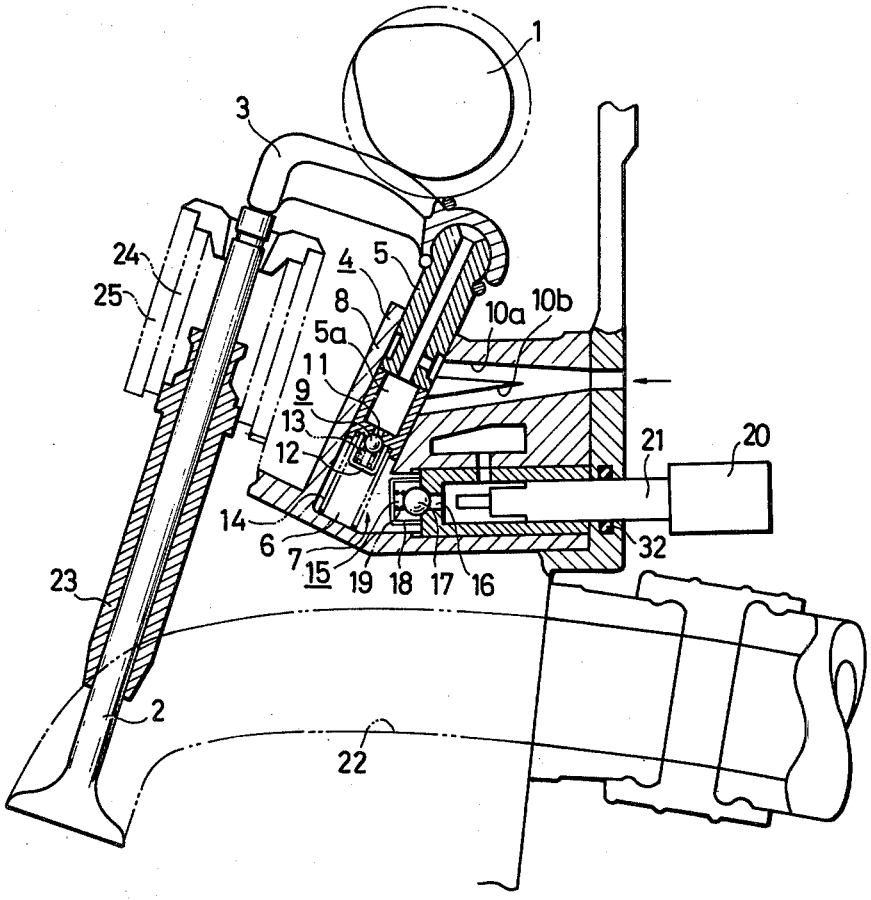
FIG. 1 PRIOR ART
FIG. 1 is a sectional view of a conventional valve actuating mechanism having a valve operation suspending function.
Figure 2:
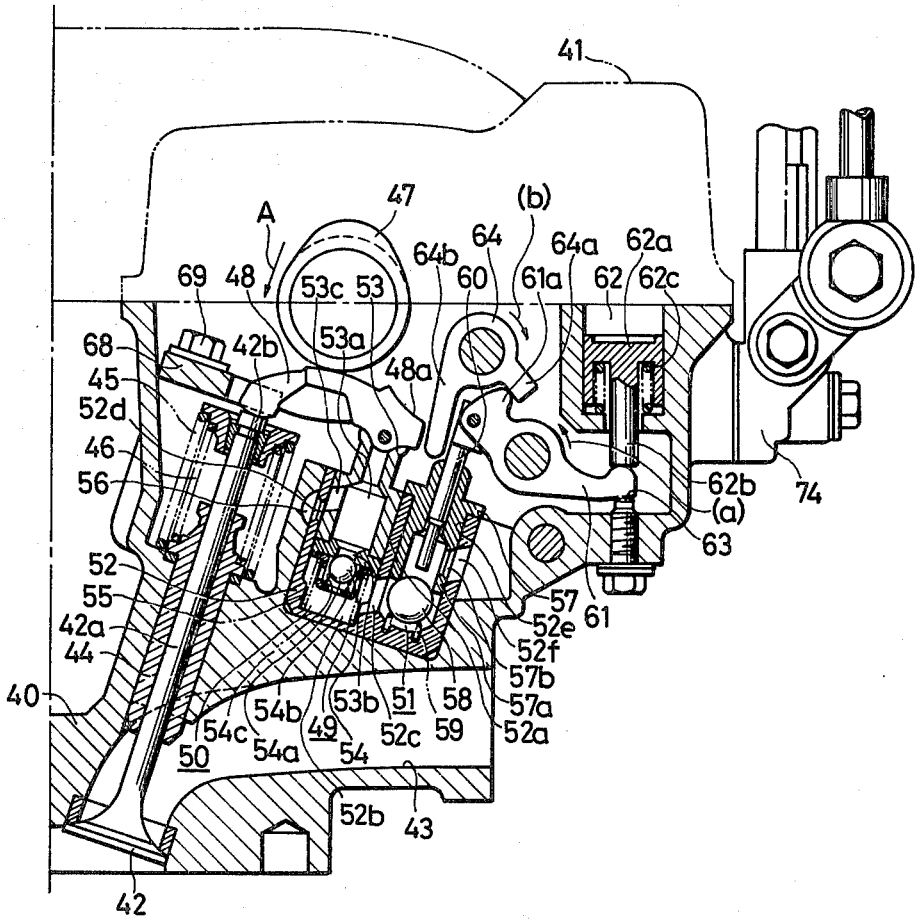
FIG. 2 is a sectional view of a valve actuating mechanism with valve operation suspending function in accordance with the invention in the state of operation.
Figure 3:
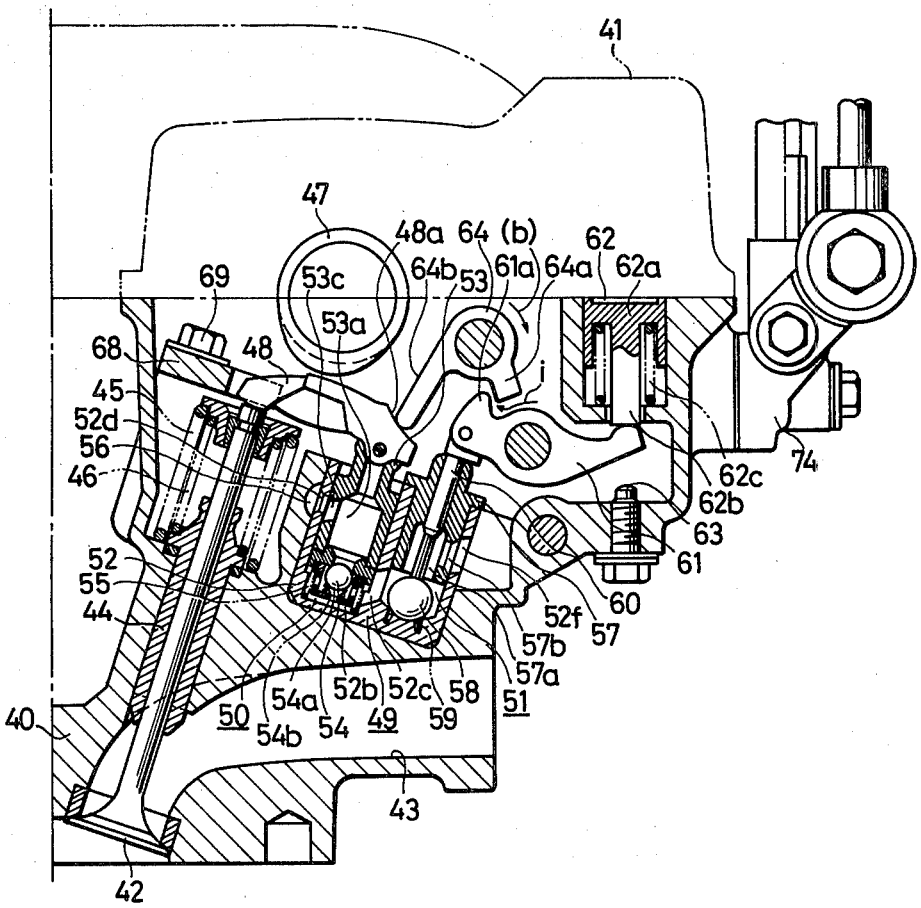
FIG. 3 is a sectional view of the mechanism shown in FIG. 2 in the state of suspension of the valve operation.

FIG. 2 shows a valve actuating mechanism having valve operation suspending function to which the invention is applied, in the state in which the valve is operative, while FIG. 3 shows the same mechanism in the state in which the valve is inoperative. In these Figures, a reference numeral 40 denotes a cylinder head, 41 denotes a cylinder head cover, 42 denotes an intake valve or an exhaust valve (referred to simply as "valve", hereinunder), 43 denotes an intake or an exhaust manifold, 44 denotes a valve guide, 45,46 denote valve springs, 47 denotes a valve actuating cam (referred to simply as "cam", hereinunder), 48 denotes a rocker arm and 49 denotes a supporting unit for supporting the fulcrum of the rocker arm.

The supporting unit 49 for supporting the fulcrum of the rocker arm is composed of a hydraulic lifter 50, i.e. retaining means, and a discharge limiting valve 51 both of which are accomodated by a common casing 52.

The hydraulic lifter 50 has a hollow plunger 53, i.e. a supporting member, engaging at its upper end with the fulcrum of the rocker arm 48 and slidably received by a cylindrical bore 52*a* formed in a casing 52. The hydraulic lifter 50 further has a high-pressure chamber 52*b* defined at the lower side of the plunger 53 and an oil discharge port 52*c* for discharging oil from the high-pressure chamber 52*b*. The hydraulic lifter 50 further provides a check valve 54 disposed in an opening 53*b* between the hollow portion 53*a* in the plunger 53 and the high-pressure chamber 55 and adapted to prevent the oil from flowing back into the hollow portion 53*a* of the plunger 53 from the high-pressure chamber 52*b*. The check valve 54 has a ball valve 54*a* biased by a spring 54*c* in a retainer 54*b* so as to be seated on the valve seat around the above-mentioned opening 53*b*. A plunger spring 55 upwardly biasing the plunger 53 is disposed within the high-pressure chamber 52*b*.

An oil supply means is provided for supplying oil to the hollow portion 53*a* of the plunger 53. Namely, an oil pump (not shown) is adapted to supply oil into the hollow portion 53*a* of the plunger 53 through an oil supply passage 56 via a hole 52*d* formed in a side wall of the casing 52 and a hole 53*c* formed in a side wall of the plunger 53.

The discharge limiting valve 51 has a hollow inner member 57 disposed in a cylindrical bore 52*e* formed in the casing 52, and a ball valve 58 seated on a valve seat around the lower opening of the hollow portion 57*a* of the inner member 57. The ball valve 58 is biased towards the valve seat by a spring 59. The interior of the inner member 57 is communicated with the outside of the casing 52 through an oil discharge port 57*b* formed in the wall of the inner member 57 and an oil discharge port 52*f* formed in the wall of the casing 52. The inner member 57 slidably receives a push rod 60 parallel to the direction of sliding of the plunger 53.

The push rod 60 is connected at its one end to one end of a control arm 61 by means of a pin. The control arm 61 is supported at its center by means of the cylinder head 40 and is biased by a control arm spring (not shown) in the direction of an arrow (a) in FIG. 2. On the other hand, the cylinder head 40 is provided with a hydraulic cylinder 62 which receives a piston 62*a* having a piston rod 62*b* held in contact with the other end of the control arm 61 to rotate the control arm 61. The hydraulic cylinder 62 is provided also with a spring 62*c* for restoring the piston 62*a*. A reference numeral 63 designates a stopper for limiting the rotation of the control arm 61.

Figure 4:
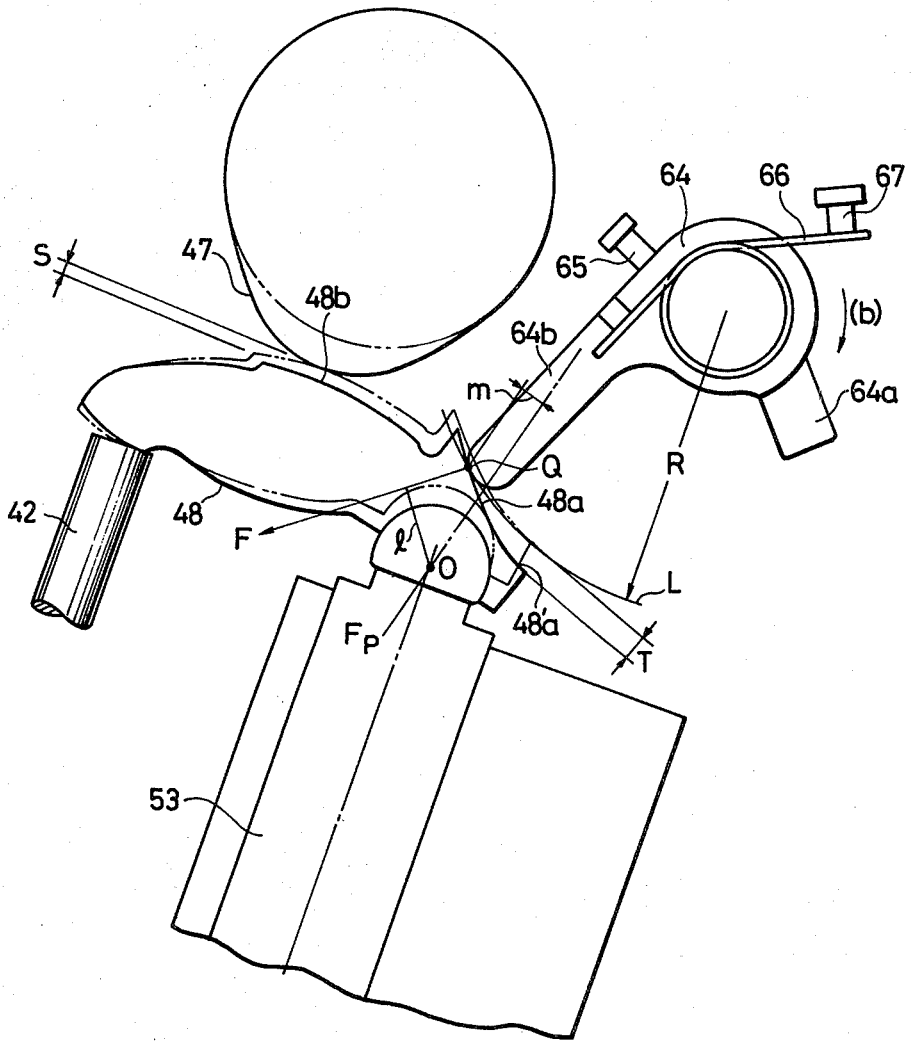
FIG. 4 is an enlarged view of the portion around the fulcrum of the rocker arm.

A pressing member 64 is disposed above the discharge limiting valve 51 and rotatably carried by the cylinder head 40. The pressing member 64 is provided with a claw portion (engaging portion) 64*a* engageable with a projection 61*a* of the control arm 61 adjacent to the push rod, and a control arm 64*b* integral with the claw portion 64*a* and adapted to selectively engage with a curved surface 48*a* formed on the upper side of the portion of the rocker arm 48 adjacent to the fulcrum. The pressing member 64 is biased by a control arm spring 66, which is in this case a torsion spring as shown in FIG. 4, in the direction of an arrow (b). The control arm spring 66 is restrained at its one end by a stopper 67 provided on the cylinder head 40 while the other end is in engagement with the pressing member 64.

An explanation will be made hereinunder as to the shapes of the control arm 64*b* and the curved surface 48*a* on the fulcrum portion of the rocker arm 48, as well as the mutual relationship therebetween, with specific reference to FIG. 4. The curved surface 48*a* of the rocker arm 48 is shaped to intersect the locus L of rotation of a radius R drawn by the end of the control arm 64*b* in such a manner that the end 48*a'* of the rocker arm 48 is positioned at the radially outer side of the locus L when the valve 42 is fully opened.

The end of the control arm 64*b*, i.e. the end contacting the curved surface 48*a* of the rocker arm 48, is rounded to have a shape with a convexed curvature to permit the control arm 64*b* smoothly move onto the curved surface 48*a* of the rocker arm 48. Furthermore, since the end of the control arm 64*b* makes a surface contact with the curved surface 48*a*, the local wear is avoided to ensure a high reliability and durability.

The curved surface 48*a* of the rocker arm 48 of the construction explained above offers the following advantage. Namely, when the control arm 64*b* is rotated in the direction of arrow (b) to make its end move onto the curved surface 48*a* of the rocker arm 48, the position of the end (right end as viewed in FIG. 4) of the curved surface 48 is lowered by T as illustrated so that the end of the control arm 64*b* is allowed to smoothly move onto the curved surface before the fulcrum of the rocker arm 48 is lowered sufficiently. Furthermore, as the control arm 64 is rotated in the direction of an arrow (b) in Fig. 4 by the force of the control arm spring 66, the rocker arm 48 is depressed by the wedging action produced by the curved surface 48i a. These actions are performed because the curved surface 48*a* is inclined to the locus L of the end of the control arm 64*b* in a manner explained before.

The length of the control arm 64*b* is selected in such a manner that the surface 48*b* making sliding contact with the cam 47 is slightly lowered from the position taken when the cam 47 is in its full lift position shown by two-dotted chain line. Therefore, when the control arm 64*b* has been rotated until it is stopped by the stopper 65, the fulcrum of the rocker arm 48 is lowered to the position shown by solid line in FIG. 4 to produce a clearance S between the cam 47 and the sliding surface 48*b* of the rocker arm 48. This clearance S is selected to eliminate any contact between the cam 47 and the sliding surface 48*b* of the rocker arm 48, which may be caused by various factors such as production errors in every parts, oscillation of the base circle of the cam 47, deflection of the cam shaft and so forth. By so doing, it is possible to eliminate any noise which may be produced by the mutual contact between the cam 47 and the sliding surface 48*b* during suspension of operation of the valve.

The position of the contact between the end of the control arm 64*b* and the curved surface 48*a* of the rocker arm is selected as follows. Namely, during suspension of operation of the valve in which the rocker arm 48 has been fully pressed downwardly, the load F exerted by the control arm 64*b* at the point of contact Q on the rocker arm 48 produces a moment expressed by $F \times l$, where l represents the arm length of the moment which is, in this case, the vertical distance between the central point O of support of the rocker arm by the plunger 53 and the line of action of the load F, and the moment $F \times l$ biases the rocker arm 48 in the opening direction, i.e. in the direction for downwardly pressing the portion of the rocker arm 48 adjacent to the valve 42 (counterclockwise direction as viewed in FIG. 4).

Furthermore, the position of the contact point Q is determined to meet also the following condition. Namely, at the center point O of support of the rocker arm by the plunger 53, the plunger 53 applies a load Fp to the rocker arm by the reactional force produced by the plunger spring 55. This load Fp produces a moment represented by $Fp \times m$, where (m) expressed the arm length of the moment which is in this case the vertical distance between the poing Q of contact and the line of action of the load Fp, the moment $Fp \times m$ also biasing the rocker arm 48 in the valve opening direction as in the case of the moment $F \times l$. Therefore, in the state in which the operation of the valve is suspended, two moments $F \times l$ and $Fp \times m$ act to bias the rocker arm 48 toward the valve opening direction to prevent the rocker arm 48 from jumping. It is, therefore, possible to prevent generation of noise or offsetting of the rocker arm due to contact between the contact surface 48*b* of the rocker arm 48 and the cam 47, attributable to the jumping of the rocker arm 48 by the vibration of the engine and other reasons.

If the moments $F \times l$ and $Fp \times m$ are too large, the loads on the valve springs 45 and 46 are lowered inconveniently. Namely, the values of the moments $F \times l$ and $Fp \times m$ may be sufficiently small becuase the tendency of jumping up of the rocker arm 48 is suppressed by a strong reactional force produced by the control arm 64*b*. In consequence, no inconvenience is caused in regard to the setting in the loads on the valve springs 45 and 46.

A reference numeral 68 designates a guide member for guiding the movement of the rocker arm 48. As will be seen from FIG. 5, the guide member 68 is disposed above the head 42*b* of the valve spindle 42*a* of the valve 42 and is fixed to the cylinder head 40 by means of bolts 69, and is provided with a groove 68*a* for guiding the end of the rocker arm 48 adjacent to the valve.

Figure 5:
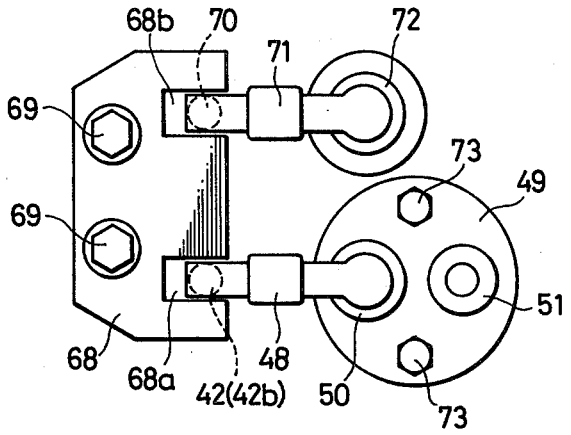
FIG. 5 is a view of an essential part of the mechanism shown in FIG. 2 as viewed in the direction of an arrow A.

In FIG. 5, a reference numeral 70 designates a valve which is always driven to open and close in response to the rotation of the cam 47, i.e. the valve the operation of which is never suspended. The valve 70 is driven by an ordinary valve actuating mechanism including a rocker arm 71 and a hydraulic lifter 72 for supporting the fulrcum of the rocker arm 71. The movement of the rocker arm 71 is guided by a groove 68*b*. The supporting unit 49 for supporting the rocker arm is secured to the cylinder head 40 by means of bolts 73.

In FIGS. 6 to 9 reference numeral 74 denotes a change-over valve device for effecting the suction and discharge of the pressurized oil into and out of the hydraulic cylinder 62.

The detail of this change-over valve device will be explained hereinunder with reference to FIGS. 6 to 10. The change-over valve device 74 has a communication passage 75 which serves both as a passage for suction of oil into the hydraulic cylinder 62 and the passage for the discharge of the oil from the same. The change-over valve device 74 further has a three-way valve 78 having one side in communication with the passage 75 and other side communicated with suction passage 76 and a discharge passage 77, respectively. The suction passage 76 is connected at its one end to the three-way valve 78 mentioned above and at its other end to an oil pump (not shown), i.e. the source of the hydraulic pressure. On the other hand, the discharge passage 77 is connected at its one end to the three-way valve 78 as mentioned above while the other end thereof is opened into the cylinder head cover 41. The discharge passage 77 has a discharge port 77*a* positioned above the communication passage 75. In the described embodiment, the discharge port 77*a* is positioned at a level higher than any portion of the passage from the hydraulic cylinder 62.

A reference numeral 79 designates a passage leading to the hydraulic cylinder similar to the hydraulic cylinder 62 but prepared for another valve having operation suspending function. This cylinder also is communicated with the communication passage 75 through a common passage 80.

To explain in more detail about the three-way valve 78, this device 78 has a spool 78*a*, solenoid 78*b*, movable core 78*c* (plunger) of the solenoid 78*b*, and a return spring 78*d* for returning the spool 78*a*.

Figure 10:
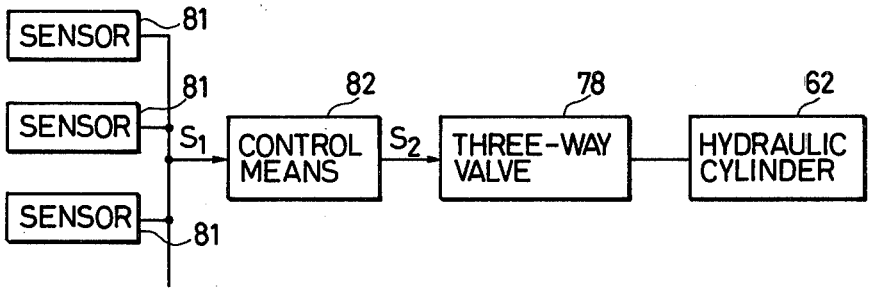
FIG. 10 is a block diagram of a change-over valve control system.

The control of the three-way valve 78 is made in a manner explained hereinunder with reference to Fig. 10. Namely, various factors such as the engine rotation speed, oil temperature, throttle opening degree, negative pressure level and the actual vehicle speed are detected by a sensor device 81 which produces a detection signal Si and delivers the same to a controller 82. The controller 82 stores the optimum timing of switching between the "inoperative" or "suspending" state and "operative" state of the valve determined beforehand by an experiment, and issues, in response to the signal Si, a switching instruction, signal S2 to the three-way valve 78 to effect a switching of the same, thereby to actuate the hydraulic cylinder 62. The arrangement is such that, as the solenoid 78*b* is energized, the state of the valve is switched from "suspending" state to "operative" state of the valve, whereas, when the solenoid 78*b* is de-energized, the state of the valve is switched from "operative" state to "suspending" state.

When all of the intake and exhaust valves are actuated, opening and closing operation of the valve 42 is made maintaining the state shown in FIG. 2.

The discharge limiting valve 51 takes the closing state with its ball valve 58 pressed onto the valve seat by means of the spring 59, so that the pressurized oil in the high-pressure chamber 52*b* is not discharged to the outside of the high-pressure chamber 52*b* of the hydraulic lifter 50. Then, as the rocker arm 48 is pressed down by the rotation of the cam 47, the plunger 53 supporting the fulcrum of the rocker arm 48 also tends to be pressed down. However, since the oil confined in the high-pressure chamber 52*b* is pressurized to a high level, the plunger 53 is prevented from coming downward so that it supports the rocker arm 48 in the state shown in FIG. 2. As a result, the rocker arm 48 is rocked around the fulcrum in response to the rotation of the cam 47 thereby to open and close the valve 42. In this case, the plunger 53 makes a vertical movement by an amount small but enough for absorbing the oscillation of the cam 47 to function as an ordinary hydraulic lifter.

Figure 6:
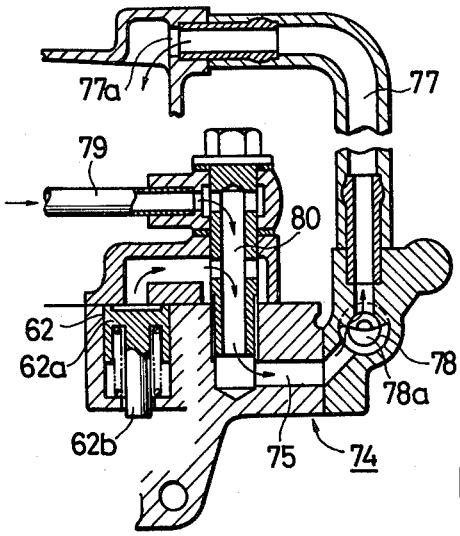
FIG. 6 is a front elevational sectional view of a change-over valve device in the state of suspension of operation of the valve.
Figure 7:
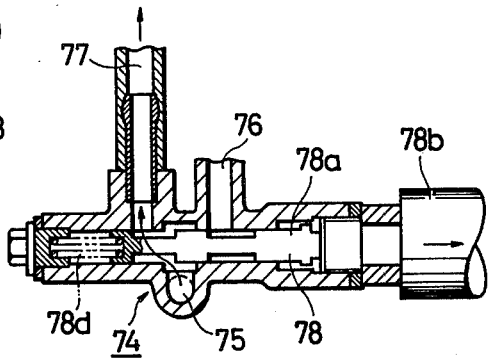
FIG. 7 is a side elevational sectional view of the change-over valve device.

The switching from the "operative" to "suspending" state of the valve is made in a manner explained hereinunder. Upon receipt of the signal from the sensors 81, the controller 82 produces a signal representing the optimum timing of suspension of the valve operation and delivers a switching instruction S2 to the three-way valve 78 thereby to de-energize the solenoid 78*b*. As a result, the three-way valve 78 is switched to take the state as shown in FIGS. 6 and 7. Therefore, the interior of the hydraulic cylinder 62 is communicated with the exterior (space in the cylinder head cover) through the discharge port 77*a*, so that the piston 62*a* biased by the spring 62*c* in the hydraulic cylinder 62, as well as the piston rod 62*b*, is moved upwardly. Consequently, the internal oil is discharged from the discharge port 77*a* via the common passage 80, communication passage 75, three-way valve 78 and the discharge passage 77.

Since the discharge port 77*a* takes a level sufficiently higher than that of the communication passage 75 and spool 78*a* of the three-way valve 78, oil still fills the hydraulic cylinder 62 and in the passage even after the discharge of the oil, i.e. even in the "suspending" state of the valve, so that the switching from the "suspending" state to "operative" state is made at a high response speed.

In order to achieve an instantaneous switching from the "operative" to "suspending" state of the valve, it is preferred that the passage for the discharge of the oil from the high-pressure chamber 52*b* should be large. That is, the passage such as the oil discharge port 52*c*, hollow portion 57*a*, discharge ports 57*b*,52*f* and the hollow portion 58*a* are made as large volume as possible.

On the other hand, the control arm 61 produces a force in the direction of the arrow (a) by the action of a control arm spring, i.e. in the direction for pressing the ball valve 58 through the push rod 60. Therefore, as the piston rod 62*b* is moved upwardly, the push rod 60 presses the ball valve 58 without delay to open the high-pressure chamber 52*b* of the hydraulic lifter 50.

Subsequently, the cam 47 presses the rocker arm 48 so that the plunger 53 supporting the fulcrum is lowered while expelling the oil from the high-pressure chamber 52*b* to the outside of the casing 52 through the discharge ports 57*b* and 52*f*. During the lowering of the plunger 53, the valve 42 does not open because of the biasing forces exerted by the valve springs 45 and 46.

On the other hand, the control arm 64*b* is always biased by the control arm spring 66 in the direction to come onto the curved surface 48*a* of the rocker arm 48, i.e. in the direction of the arrow (b) in FIG. 2. Therefore, when the piston rod 62*b* of the hydraulic cylinder 62 is raised to nullify the force acting to pull the control arm 64*b* in the direction opposite to the direction of the arrow (b), the end of the control arm 64*b* abuts on the end of the rocker arm 48 adjacent to the fulcrum without delay, so that it can move and ride onto the curved surface 48*a* of the rocker arm 48 as soon as the fulcrum of the latter is lowered.

Therefore, immediately after the fulcrum of the rocker arm 4 is lowered as a result of the downward movement of the plunger 53, the control arm 64*b* moves onto the curved surface 48*a* of the rocker arm 48. Since the arrangement is such that the curved surface 48*a* crosses the locus L of the end of the control arm 64*b* with the end 48*a*' thereof adjacent to the fulcrum positioned outside the locus L, the curved surface 48*a* produces a wedging effect to permit the fulcrum of the rocker arm 48 to be further lowered by a small force F at the end of the arm, so that a small clearance S is maintained between the cam 47 and the rocker arm 48. Thus, the fulcrum of the rocker arm 48 and the plunger 53 are held in the depressed state to maintain the valve in the "suspending" or inoperative state.

The depressing force exerted by the control arm 64*b* on the rocker arm 48 for depressing the latter is not lowered even during the lowering of the rocker arm 48, as will be understood from the following explanation. Assume here that the depression of the rocker arm 48 is effected by a pressing member which is movable up and down in the direction of sliding of the plunger and downwardly biased by a spring, the reactional force of the spring gets smaller as the rocker arm 48 is lowered so that the pressing member cannot produce the sufficient force for holding the fulcrum of the rocker arm 48 in the depressed position. In consequence, noises are tend to be generated as a result of the vibration of the engine. In order to avoid this problem, it is necessary to increase the load of the spring, which in turn increases the mechanical strengths of every parts resulting in an increased weight of the mechanism. In contrast, in the mechanism in accordance with the invention, the force for depressing the rocker arm 48 is never reduced even after the lowering of the rocker arm 48, because the control arm 64*b* is rotated to ride the curved surface 48*a* of the rocker arm. Therefore, the rocker arm 48 is held stably to prevent generation of vibration and noise.

An explanation will be made hereinunder as to the operation for switching the state of the valve from the "suspending" or inoperative state to the "operative" state.

Figure 8:
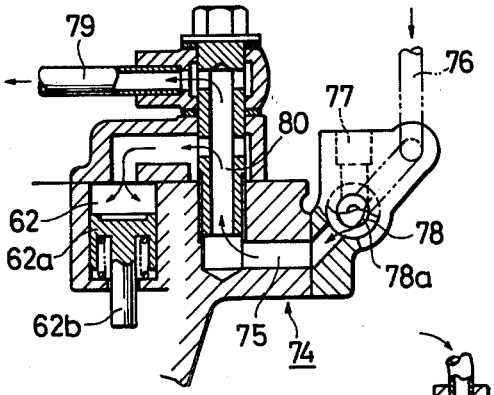
FIG. 8 is a front elevational sectional view of the change-over valve device in the operating state of the valve.
Figure 9:
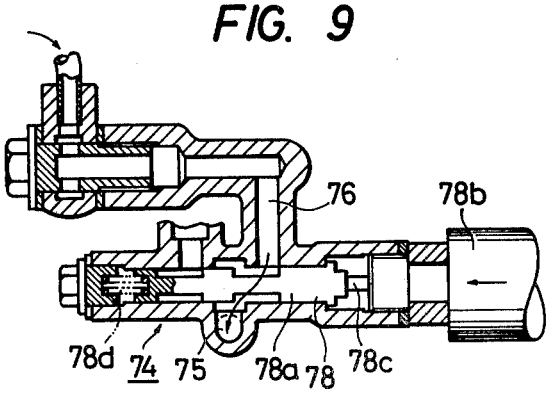
FIG. 9 is a side elevational sectional view of the change-over valve device in the operating state of the valve.

As the controller 82 delivers a switching instruction S2, the solenoid 78*b* of the three-way valve 78 is energized so that the three-way valve 78 is switched to take the state as shown in FIGS. 8 and 9. In consequence, the pressurized oil coming from the oil pump (not shown) is supplied to the hydraulic cylinder 62 through the suction passage 76, three-way valve 78, communication passage 75 and the common passage 80, as indicated by an arrow. As a result, the piston 62*a* and, hence, the piston rod 62*b* are lowered to depress the control arm 61. Referring to FIG. 3, therefore, the control arm 61 is rotated in the direction opposite to the direction of the arrow (a) so that the push rod 60 is pulled up to make the ball valve 58 to be seated on the valve seat by the force of the spring 59, and then, the claw member 64*a* of the claw 64 is pressed to cause the pressing member 64 to rotate in the direction opposite to the arrow (b). In consequence, the control arm 64*b* is disengaged from the curved surface 48*a* of the rocker arm 48 to render the plunger 53 being free. In consequence, the plunger 53 is moved by the reactional force exerted by the spring 55 to restore the "operative" state of the valve as shown in FIG. 2. For permitting an instantaneous recovery of the "operative" state, the passage around the ball valves 54*a* and 58, e.g. passages 53*a* and 57*a*, are made ample enough to permit a rapid filling of the high-pressure chamber 52*b* with the oil in response to the rise of the plunger 53.

In order to ensure a rapid seating of the ball valve 58 on the valve seat in the discharge limiting valve 51 to promptly put the hydraulic lifter 50 into effect before the cam 47 and the rocker arm 48 contact with each other, a play shown by (i) in FIG. 3 is generated between the claw member 64*a* of the pressing member 64 and the projection 61*a* of the control arm 61 in the "suspending" or inoperative state of the valve.

Figure 11:
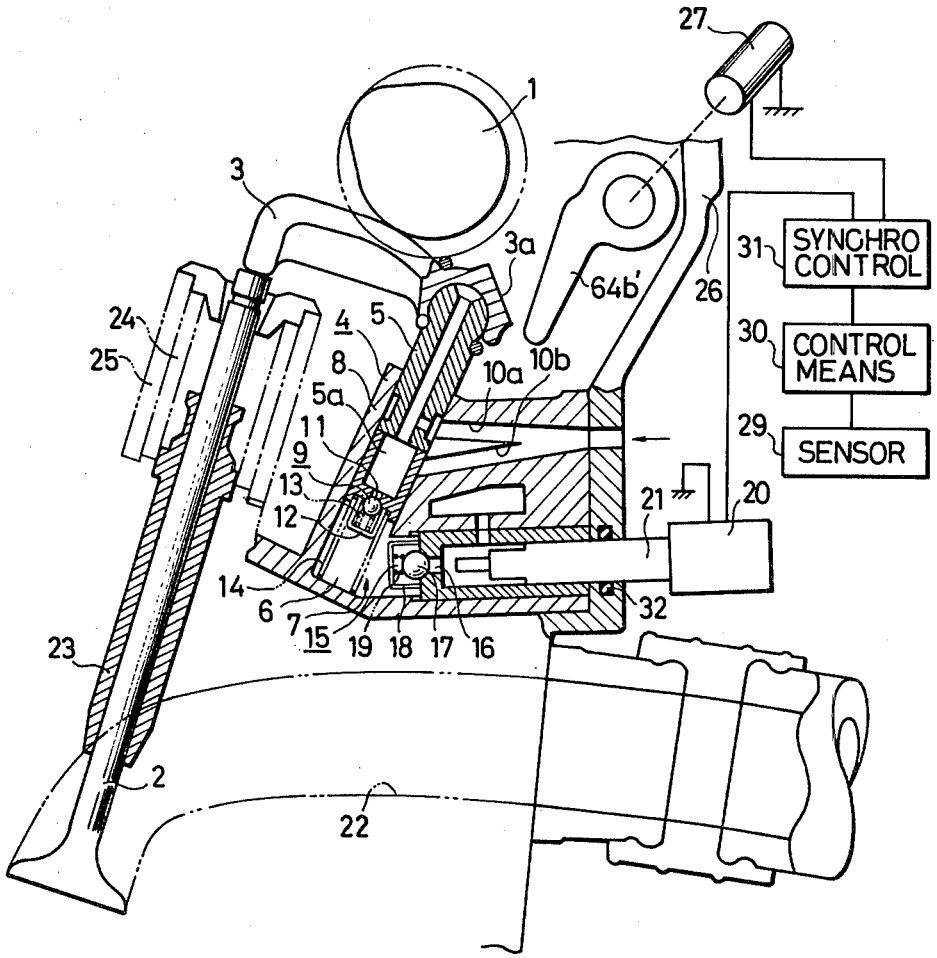
FIG. 11 is an illustration of an application of a control arm to a conventional valve actuating mechanism.

FIG. 11 illustrates a conceivable application of the control arm 64*b'* to the conventional mechanism.

An inclined surface 3*a* is formed on the fulcrum portion of the rocker arm 3. On the other hand, a control arm 64*b'* driven by a motor 27 is secured to the cylinder head 26. The control arm 64*b'* is capable of riding the inclined surface 3*a* when the plunger 5 is lowered. A reference numeral 29 denotes a sensor for sensing the engine speed, 30 denotes a controller and 31 denotes a synchronous control circuit. The sensor 29, controller 30 and the synchronous circuit 31 cooperate with one another to operate the solenoid 20 and the motor 27 in synchronism at a timing sensed by the sensor 29. Thus, the push rod 29 of the discharge limiting valve 15 and the control arm 28 operate in synchronism with each other. In order to prevent the oil from leaking outside, an "O"-ring 32 is disposed in a bore formed in the cylinder head 26 for receiving the push rod 21.

In the operation of this valve actuating mechanism, as the cam 1 make one rotation, the rocker arm 3 rocks around the fulcrum supported by the plunger 5 of the hydraulic lifter 4 thereby to open and close the valve 2. In this case, the hydraulic lifter 4 eliminates any clearance or play in the mechanism to ensure a silent and maintenance-free operation. As the solenoid 20 is energized in this state, the push rod 21 is moved to the left as viewed in the drawing to press the valve member 17 to the left as viewed in the Figure to urge the ball valve 17 away from the valve seat to permit the oil to be relieved from the high-pressure chamber 6 through the passage 16 which is now opened. Therefore, when the cam 1 is in the lifting position, the plunger 53 supporting the fulcrum of the rocker arm 3 is lowered, because the force of the spring 14 for upwardly biasing the plunger 5 is selected to be smaller than the forces of the valve springs 24 and 25.

As the fulcrum of the plunger 5 is lowered, the control arm 64*b'* is driven by the motor 27 which operates in synchronism with the solenoid 20, so that the control arm 64i b' is rotated clockwise as viewed in Figure to make its end ride the inclined surface 3*a* of the rocker arm 3. Therefore, the fulcrum of the rocker arm 3 and the plunger 5 are held in the lowered positions. Consequently, the rocker arm 3 does not operate in response to the rotation of the cam 1 so that the valve 2 is held in the closed state to suspend its operation. This arrangement for holding the plunger 5 in the lowered position regardless of the rotation of the cam during suspension of operation of the valve offers the following disadvantages. Namely, this arrangement is effective in eliminating the wasteful or useless work for driving the plunger 5 up and down in response to the rotation of the cam 1 in the "suspending" or inoperative state of the valve, and also in eliminating the generation of the bubbles in the oil due to cavitation as a result of the reciprocal movement of the oil into and out of the high-pressure chamber 6 through the passage 16, the bubbles remaining in the high-pressure chamber 6 unfavourably imparing the function of the hydraulic lifter 4 for maintaining the fulcrum of the rocker arm 3 rigid when the suspension of operation of the valve is dismissed. The elimination of generation of bubbles also suppresses the tendency of corrosion of mechanical parts due to ozonic gases contained by these valves.

For dismissing the suspension of operation of the valve, the solenoid 20 is de-energized to drive the plunger 21 of the discharge limiting valve 15 thereby to close the latter and, thereafter, the motor 27 is started to rotate the control arm 64*b'* counter-clockwise out of engagement with the tapered surface 3*a* of the rocker arm 3. As a result, the hydraulic lifter 4 becomes operative to make the valve 2 to open and close in response to the rotation of the cam 1.

As has been stated, the push rod 21 of the discharge limiting valve 15 and the control arm 28 operate in synchronism with each other. Particularly, it is necessary that the timings of the closing of the discharge limiting valve 15 and the timing of disengagement of the control arm 64*b*′ from the inclined surface 3*a* of the rocker arm 3 are determined such that the disengagement of the control arm 64*b*′ is made only after the closing of the discharge limiting valve 15. If this relation of timing is reversed or if the closing of the valve 15 and the disengagement of the control arm 64*b* are made simultaneously, various inconveniences may be caused by the wasteful vertical movement of the plunger and generation of bubbles in the oil. To realize the above-explained relation of timings correctly, an electric control means is employed. The precise control of these timings, however, requires a complicated electric arrangement resulting in a raised cost. On the other hand, if this synchronism of operation between the plunger 5 and the discharge limiting valve has to be made by means of a linking mechanism, a complicated construction is required to raise the production cost partly because the plunger 5 and the push rod 21 of the discharge limiting valve 15 extend substantially at a right angle to each other to space the ends of these two members away from each other and partly because the push rod 21 having one end extending to the outside of the cylinder head 26 to require a hydraulic seal such as an "O38 -ring 32.

According to the invention, the direction of sliding of the plunger of the hydraulic lifter 50 is an parallel to the axis of the push rod 60. With this arrangement, it is possible to realize a simple and reliable construction of linking device between the mechanism for dismissing the pressing of the rocker arm 48 and the mechanism for driving the discharge limiting valve 15 in the opening direction, i.e. the construction for operatively connecting the control arm 61 and the pressing member 64. The push rod 60 need not always be precisely parallel to the direction of sliding of the plunger 53. Namely, it suffices only that the push rod 60 and the plunger 53 extend in almost equal direction substantially in parallel to each other with their upper ends of the plunger 53 and the push rod 60 positioned close to each other.

By making the plunger slide in parallel with the push rod 60, it is possible to obtain a compact construction of the supporting unit for supporting the fulcrum of the rocker arm, in which the hydraulic lifter 50 and the discharge limiting valve 51 are housed by a single casing 52. In addition, since the push rod 60 does not extend to the outside of the cylinder head 40 unlike the conventional arrangement, it is not necessary to provide an oil-tight seal such as "O"-rings.

As has been described, according to the invention, there is provided a valve actuating method with a function for suspending valve operation in an internal combustion engine, wherein an intake valve or an exhaust valve is actuated by a rocker arm which operates following up the operation of the valve actuating cam in synchronism with the engine operation, the rocker arm being supported at its one end in a rigid manner by a supporting member retained by the cylinder head of the engine through a retaining member, the retaining of the supporting member by the retaining member is selectively dismissed to nullify the supporting reactional force for the rocker arm to permit the supporting member to float thereby to effect a suspension of operation of the valve, wherein the improvement comprises that the retaining of the supporting member by the retaining member is dismissed to permit the supporting member to float with respect to the cylinder head and that the supporting member is held at a position where the rocker arm and the valve actuating cam do not make sliding contact with each other.

Therefore, during the suspension of operation of the valve, the rocker arm and the plunger (supporting member) of the hydraulic lifter supporting the fulcrum of the rocker arm are kept still without moving up and down regardless of the rotation of the cam.

In consequence, the wasteful work for driving the plunger overcoming the force of the plunger spring, inevitable in the conventional arrangement, is eliminated.

Furthermore, since the plunger is kept still, the movement of the oil into and out of the high-pressure chamber is avoided to prevent the generation of bubbles by the cavitation of oil in the high-pressure chamber. In consequence, the hydraulic lifter performs without fail the function for supporting the fulcrum of the rocker arm rigid when the valve is put into the operative state. Furthermore, the tendency of corrosion of mechanical parts due to ozonic gases contained by bubbles in the oil is suppressed because the cavitation which causes the generation of such bubbles is avoided.

According to another feature of the invention, a moment $F \times l$ is generated by the load F applied to the rocker arm by the control arm. In some cases, a moment $Fp \times m$ is produced besides the above-mentioned moment $F \times l$, by the load Fp produced by the upward force of the plunger spring and exerted by the plunger on the rocker arm at a point near the center of the support for the rocker arm. The moment $F \times l$ solely or in combination with the moment $Fp \times m$ serves to bias the rocker arm in the valve opening direction thereby to stably hold the rocker arm during suspension of operation of the valve. It is, therefore, possible to eliminate inconveniences such as generation of noises as well as the dropping of the rocker arm due to contact between the rocker arm and the cam.

It is to be noted that, in the mechanism to which the method of the invention is applied, the curved surface of the fulcrum portion of the rocker arm intersects the locus drawn by the end of the control arm such that the end of the rocker arm adjacent to the fulcrum thereof is located at the radially outer side of the locus mentioned above. As a result, a wedging effect is produced to act between the curved surface and the control arm, so that the control arm can be biased even by a weak resilient member. Furthermore, the pressing force for downwardly pressing the rocker arm is never decreased even after the lowering of the rocker arm to prevent generation of vibration and noise.

In addition, by making the end of the control arm has a convexed curved surface, it is possible to attain a surface contact with respect to the curved surface of the rocker arm, to thereby attain a high durability and reliability while avoiding any local wear. Further, more preferable effect for suppressing the generation of noise is attained by selecting the length of the arm to preserve a clearance S between the cam and the rocker arm.

Furthermore, according to the invention, the direction of the sliding motion of the plunger of the hydraulic lifter for supporting the fulcrum of the rocker arm is selected to be substantially equal to the direction of motion of the valve in the discharge limiting valve for controlling the opening and closing of the high-pressure chamber of the hydraulic lifter, i.e. the direction of axis of the push rod. According to this arrangement, it is possible to realize the operative connection between the control arm for depressing the fulcrum of the rocker arm and the push rod with a simple construction. Consequently, the invention provides a simple and less expensive valve actuating mechanism with valve operation suspending function in which the rocker arm does not rock during suspension of the valve operation, without necessitating complicated electric circuit or link mechanism.

Furthermore, since the control of the timings of the control arm and the push rod is effected by a simple mechanical construction, the operations of the control arm and the push rod are achieved in quite a correct manner to ensure a much higher reliability than those achieved conventionally by an electric circuit or complicated link mechanism.

Finally, it is to be noted that the hydraulic lifter and the discharge limiting valve can be accomodated by a single casing to form a rocker arm fulcrum supporting unit in which the hydraulic lifter and the discharge limiting valve are freely separable, since the push rod does not extend to the outside of the cylinder head. This arrangement facilitates the inspection and the maintenance work considerably.

What is claimed is:

1. In a valve actuating method with a function for suspending valve operation in an internal combustion engine, wherein each of intake and exhaust valves is actuated by a rocker arm operated in response to the rotation of valve actuating cam in synchronism with the engine operation, said rocker arm being supported at its one end in a rigid manner by a supporting member retained by a cylinder head of said engine through a retaining member, the retention of said supporting member by said retaining member is selectively dismissed to nullify said supporting reactional force for said rocker arm to permit said supporting member to float to thereby effect suspension of operation of said valve, an improvement comprising the steps of; releasing the retention of said supporting member by said retaining member to permit said supporting member to float with respect to said cylinder head during valve suspension, and holding said supporting member at a position where sliding contact between said rocker arm and said valve actuating cam is prevented.

2. Valve actuating method with a function for suspending valve operation as claimed in claim 1, wherein said rocker arm is held at a position to urge the same toward valve opening direction, said rocker arm fixing method comprising the steps of; riding a control arm onto a curved surface of said rocker arm, and biasing said control arm toward curving direction of said curved surface by a resilient member during valve suspension, said control arm being positioned above said supporting member and said curved surface being provided at an upper surface of said rocker arm at a position adjacent to its fulcrum point; and generating a moment $F \times l$ during valve suspension, to thereby bias said rocker arm toward valve opening direction, said load F designating a load at a contacting surface between an end of said control arm and said curved surface of said rocker arm, and l designating an arm length coincident with a distance between central point O of said rocker arm and a line of action of said load F.

3. Valve actuating method with a function for suspending valve operation as claimed in claim 2, further comprising the step of; generating an additional moment $Fp \times m$ to further bias said rocker arm toward valve opening direction, said Fp designating load of said supporting member against said rocker arm at a central supporting point of said rocker arm, and m designating an arm length of moment coincident with a distance between a point at which said end of said control arm contacts said curved surface and a line of action of said load Fp.

4. In a valve actuating mechanism having a valve operation suspending function, including a rocker arm for actuating an intake or exhaust valve in accordance with the rotation of a cam operated in synchronism with the engine rotation, and a supporting member adapted to support one end of said rocker arm, said supporting member being provided at a cylinder head through a retaining member, the retention of said supporting member by said retaining member being selectively dismissed to nullify the supporting reactional force for said rocker arm to make said supporting member float to thereby effect a suspension of operation of said valve, the improvement comprising: said rocker arm formed with a curved surface at its upper end at a position adjacent to a fulcrum point thereof, and a control arm disposed above said supporting member and biased by a resilient member in a direction of curving of said curved surface so as to be able to move onto said curved surface during the suspension of operation of said valve; said curved surface being formed to intersect the locus of rotation of an end of said control arm such that the end of said rocker arm adjacent to the fulcrum is located outside said locus when said valve is fully opened.

5. A valve actuating mechanism having a valve operation suspending function as claimed in claim 4, wherein the surface of the end of said control arm contacting said curved surface of said rocker arm has a convex curvature.

6. A valve actuating mechanism having a valve operation suspending function, said mechanism including a rocker arm adapted to open and close an intake or exhaust valve in response to a rotation of a cam operated in synchronism with a rotation of a crankshaft of an engine, and a hydraulic lifter provided with a plunger vertically movably received by casing to from a high-pressure chamber at the lower side thereof, said plunger being adapted to support at its upper end the fulcrum of said rocker arm by a static reactional force generated by the pressure of oil confined in said high-pressure chamber, the improvement comprising a discharge limiting valve adapted to limit oil discharge from an oil discharge port leading from said high-pressure chamber of said lifter; a control member adapted to make a rotary motion to open and close said discharge limiting valve; and a pressing member integrally having an engaging portion adapted to engage said control arm during rotation of said control member and a control arm adapted to engage a curved surface on the surface of the fulcrum portion of said rocker arm, said pressing member being rotated in accordance with the rotation of said control member, whereby when said discharge limiting valve is operated by said control member, said control arm of said pressing member operating in accordance with said control member acts to depress said curved surface of said rocker arm to hold the fulcrum portion of said rocker arm in a lowered position.

7. A valve actuating mechanism as claimed in claim 6, wherein said discharge limiting valve includes a valve member movable substantially in the same direction as the sliding direction of said plunger and adapted to limit the discharge of oil from said high-pressure chamber of said hydraulic lifter, and wherein said control arm operates said valve member through a push rod operated in the same direction as said valve member.

* * * * *